US010348016B2

(12) United States Patent
Carletti et al.

(10) Patent No.: US 10,348,016 B2
(45) Date of Patent: Jul. 9, 2019

(54) CONNECTION SYSTEM SUITED TO CONNECT A PLASMA CUTTING TORCH TO A GENERATOR

(71) Applicant: TRAFIMET GROUP S.P.A., Castegnero (IT)

(72) Inventors: Claudio Carletti, Costermano (IT); Ugo Simioni, Vicenza (IT); Attilio Imi, Pagnacco (IT)

(73) Assignee: TRAFIMET GROUP S.P.A., Castegnero (IT)

( * ) Notice: Subject to any disclaimer, the term of this patent is extended or adjusted under 35 U.S.C. 154(b) by 0 days.

(21) Appl. No.: 15/749,995

(22) PCT Filed: Jul. 29, 2016

(86) PCT No.: PCT/IB2016/054564
§ 371 (c)(1),
(2) Date: Feb. 2, 2018

(87) PCT Pub. No.: WO2017/021849
PCT Pub. Date: Feb. 9, 2017

(65) Prior Publication Data

US 2018/0233842 A1 Aug. 16, 2018

(30) Foreign Application Priority Data

Aug. 3, 2015 (IT) ..... 102015000041439

(51) Int. Cl.
*H01R 4/60* (2006.01)
*H01R 13/00* (2006.01)
(Continued)

(52) U.S. Cl.
CPC ..... *H01R 13/005* (2013.01); *H01R 13/207* (2013.01); *H01R 13/5025* (2013.01);
(Continued)

(58) Field of Classification Search
CPC ..... H01R 39/56
(Continued)

(56) References Cited

U.S. PATENT DOCUMENTS 2,742,626 A * 4/1956 Collins ..... H01R 13/2421 439/363
3,847,287 A 11/1974 Dinse
(Continued)

OTHER PUBLICATIONS

International Search Report Relating to International Application No. PCT/IB2016/054564—dated Sep. 30, 2016.

*Primary Examiner* — Phuong K Dinh
(74) *Attorney, Agent, or Firm* — Millen, White, Zelano & Branigan, P.C.; William Nixon

(57) ABSTRACT

A connection system connects a plasma torch to a generator to allow the passage of electric current, the passage of an operating fluid, and of one or more control signals between the generator and the torch. The system includes a first connector and a second connector that are removably connected to each other. The first connector includes a first current-carrying terminal and the second connector having a second current-carrying terminal. The current-carrying terminals are suited to be mutually connected to each other. The first connector includes one or more electric terminals. The second connector includes one or more electric terminals, the connectors being suited to be mutually connected to each other. In the first connector, the electric terminals are movable with respect to the first terminal.

12 Claims, 8 Drawing Sheets

(51) Int. Cl.

| | |
|---|---|
| ***H05H 1/34*** | (2006.01) |
| ***H01R 13/207*** | (2006.01) |
| ***H01R 13/502*** | (2006.01) |
| ***H01R 13/52*** | (2006.01) |
| ***H01R 13/625*** | (2006.01) |
| ***H01R 24/38*** | (2011.01) |
| ***H01R 43/26*** | (2006.01) |
| ***H05H 1/36*** | (2006.01) |

(52) U.S. Cl.
CPC ..... *H01R 13/5202* (2013.01); *H01R 13/5219* (2013.01); *H01R 13/625* (2013.01); *H01R 24/38* (2013.01); *H01R 43/26* (2013.01); *H05H 1/34* (2013.01); *H05H 1/36* (2013.01); *H05H 2001/3473* (2013.01)

(58) Field of Classification Search
USPC ..... 439/191, 700
See application file for complete search history.

(56) References Cited

U.S. PATENT DOCUMENTS

| | | | | |
|---|---|---|---|---|
| 4,270,824 | A * | 6/1981 | Erickson | B23K 9/323 219/137.63 |
| 6,910,911 | B2 * | 6/2005 | Mellott | H01R 13/2421 439/180 |
| 2003/0100208 | A1 | 5/2003 | Conway et al. | |
| 2004/0140295 | A1 | 7/2004 | Herres | |

* cited by examiner 10
11
12
90b
90a
32
15a 10
11
12
13
26
32
65
31
15a
27
32

16
40
142a
142b
41
15
42a
42b
25
36
35
48
35a
35b
31
37
15a
11a
14
13
PLASMA
21
22
18
90a
65
12
X
20
30
10
23
11b
143b
43b
11c
11c
11c
11c 1
10
11
12
14
15
15a
16
30
31
32
35a
35b
40
50
51
53
53a
56
56a
61
62
70
75
90b
91
102a
X
A
B
C 1
10
11
12
14
15
15a
16
30
31
32
35a
35b
40
48
49
50
51
53
53a
56
56a
61
62
70
75
90b
91
102a
A
B
C
X 1
10
11
12
14
15
15a
16
30
31
32
35b
40
48
49
50
51
53
53a
56
56a
58
61
62
70
75
90a
91
102a
X
A
B
C

CONNECTION SYSTEM SUITED TO CONNECT A PLASMA CUTTING TORCH TO A GENERATOR

TECHNICAL FIELD OF THE INVENTION

The present invention concerns the production of a connection system used in plasma cutting and/or marking devices.

In particular, the present invention concerns a connection system used to connect a plasma torch to a generator.

The present invention also concerns a connection method used to connect a plasma torch to a generator.

DESCRIPTION OF THE STATE OF THE ART

The use of technologies for welding and/or cutting and/or marking materials, typically metallic materials, is known in several sectors, and in particular in the industrial sector.

These technologies include the use of apposite devices by specialized operators who work on the material to be welded and/or cut and/or marked.

Said devices of the known type exploit the effect produced by the generation of an electric arc. The process of generation of an electric arc can be exploited in a first case to weld metallic materials, with or without weld material. The known processes of this type include TIG (Tungsten Inert Gas) welding, the welding technologies grouped under the acronym GMAW (Gas Metal Arc Welding) and also known as metal arc welding with gas protection, which include, in particular, MIG (Metal Inert Gas) or MAG (Metal Active Gas) welding.

In other cases, the process of generation of an electric arc can be exploited to create plasma that cuts or marks a material, typically a metal piece.

In any case, said devices comprise an element suited to be handled by the operator, known under the name of torch, at the end of which, at the level of an apposite electrode, the electric arc is struck and maintained.

Furthermore, depending on the technology used, one or more fluids are also conveyed to the torch, for example a welding protection gas and/or an electrode cooling fluid, for example water and/or air.

The device thus comprises a first unit, or generator, suited to supply electric power to the torch for the generation of the arc and to supply the torch with the fluids that are necessary for its operation, for example with a gas cylinder, an air compressor and/or a hydraulic circuit for feeding cooling water. Furthermore, inside the generator there is also the unit that controls and manages the operation of the device.

A power supply line (torch cable) is then arranged between the generator and the torch, said power supply line being suited to electrically connect the generator to the torch itself. Said fluids necessary for the operation of the device, for example gas and/or air and/or cooling water, as well as control signals between the generator and the torch, are furthermore conveyed along the same cable.

Therefore, inside the torch cable there is a plurality of hydraulic and electric conductors for the electric and hydraulic connection and the transmission of the control signals.

One end of said cable is thus connected to the torch, while between the generator and the other end of the cable there is a system for connection to the generator.

According to a first system for connection to the generator, inside the generator the hydraulic and electric conductors of the torch are directly connected with their ends to the respective units, like the electric power supply or the gas and/or air and/or cooling water hydraulic circuits and/or the control and management unit.

This type of connection is rigid and quite uncomfortable to use in case of repairs or replacement of the worn parts, like the torch, for example.

For this purpose in the known technique removable systems are widely used to connect the torch cable to the generator, which allow the torch cable and the generator to be rapidly connected to and disconnected from each other.

Removable connection systems of the known type generally comprise a series of female connectors on the generator side, where corresponding male connectors present on the terminal of the torch cable are inserted. The torch cable terminal furthermore comprises an internally threaded metal ring that encloses the various connectors. Said threaded metal ring is suited to be screwed into a corresponding external thread of a ring that encloses the female connectors on the generator side.

The mutual coupling of the male and female connectors ensures the electric and hydraulic connection and the transmission of control signals between the generator and the torch cable, while the metal ring and the threaded ring guarantee the mutual mechanical connection between the parts.

However, the removable connection systems of the known type pose some drawbacks.

A first drawback that results from the use of such connection systems lies in that the threaded metal ring needs to be screwed with a high number of turns before the mutual fixed connection is obtained. The presence of threads, furthermore, does not make it possible to establish when there is a correct mutual connection between the various connectors or, even worse, to establish whether the turns given to the metal ring are sufficient to guarantee the correct connection of all the connectors.

As a consequence of the above, during the continued use of the device the continuous movements of the torch cable may cause the connection between the metal ring and/or the connectors to fail, with a consequent malfunction of the device.

Another drawback posed by the connection systems of the known type is constituted by the fact that the connection requires the correct alignment of the metal ring with the threaded ring, in order to allow the screwing operation to be carried out correctly.

A further drawback posed by the connection systems of the known type is constituted by safety problems both during the connection of the two parts and during the accidental and/or intentional disconnection of the same two parts.

In particular, there is the risk of producing an electric arc or discharge when the two parts are near each other during their connection or disconnection. Other problems, in particular during the disconnection operation, may arise due to the pressure of the fluid, for example air or gas, which causes the two parts to come abruptly off each other, in particular the terminal on the cable torch side.

Both of these situations may cause even serious consequences for any person in the vicinity.

A connection system according to the state of the art is known from documents U.S. Pat. Nos. 4,270,824, 3,847,287, US 2004/0140295 and US 2003/0100208.

It is the object of the present invention to at least partially overcome the drawbacks described above.

It is a first object of the invention to implement a connection system suited to connect a plasma torch to a generator while at the same time simplifying the connection/disconnection operations compared to the systems of the known type.

It is another object of the invention to implement a connection system suited to connect a plasma torch to a generator and lasting longer than the connection systems of the known type.

It is a further object of the invention to implement a connection system suited to connect a plasma torch to a generator and more reliable than the systems of the known type.

It is another object of the invention to implement a connection system suited to connect a plasma torch to a generator and offering improved safety conditions compared to the connection systems of the known type.

SUMMARY OF THE INVENTION

The present invention is based on the general consideration according to which the problems described with reference to the state of the art can be at least partially overcome through the implementation of a connection system suited to connect a plasma torch to a generator in order to allow the passage of electric current, the passage of at least one operating fluid and the transmission of one or more control signals between the generator and the torch, wherein the connection system comprises a first connector suited to be connected either to the torch or to the generator and a second connector respectively connected either to the generator or to the torch, the first connector and the second connector being suited to be removably connected to each other, and wherein the first connector comprises a first current-carrying terminal suited to carry the electric current and one or more electric terminals for said one or more control signals, said electric terminals being movable with respect to the first current-carrying terminal.

According to a first aspect of the present invention, the subject of the same is a connection system suited to connect a plasma torch to a generator in order to allow the passage of electric current, the passage of at least one operating fluid and the transmission of one or more control signals between said generator and said torch, said connection system comprising a first connector suited to be connected either to said torch or to said generator and a second connector suited to be respectively connected either to said generator or to said torch, said first connector and said second connector being suited to be removably connected to each other, wherein said first connector comprises a first current-carrying terminal suited to carry said electric current and said second connector comprises a second current-carrying terminal suited to carry said electric current, said current-carrying terminals being suited to be mutually connected to each other, and wherein said first connector comprises one or more electric terminals for said one or more control signals and said second connector comprises one or more electric terminals for said one or more control signals, said electric terminals of said connectors being suited to be mutually connected to each other, wherein in said first connector said electric terminals are movable with respect to said first current-carrying terminal.

Preferably, in said first connector the electric terminals are movable with respect to the first current-carrying terminal, in such a way that during the connection or disconnection of the first connector to/from the second connector the first current-carrying terminal and the second current-carrying terminal are electrically connected to each other, while the electric terminals of the first connector can assume a first position in which they are disconnected from the electric terminals of the second connector and a second position in which they are connected to the electric terminals of the second connector.

According to a preferred embodiment of the invention, the first connector comprises a first supporting element for the first current-carrying terminal and a second supporting element for the electric terminals, the second supporting element being movable along an axial direction with respect to the first supporting element, in order to allow the electric terminals to be arranged in the first position or in the second position.

In a first embodiment the first connector comprises means suited to define end-of-stroke positions of the second supporting element with respect to the first supporting element in said axial direction.

According to a preferred embodiment of the invention, the first connector comprises elastic thrusting means suited to thrust and/or maintain the second supporting element and the electric terminals in the second position.

In a preferred embodiment, the first supporting element comprises a casing suited to integrally support the first current-carrying terminal and the second supporting element comprises a metal ring suited to integrally support the electric terminals.

Preferably, the first current-carrying terminal comprises a body that develops longitudinally along said axial direction and the metal ring is provided with a centre hole suited to accommodate the first current-carrying terminal, said metal ring being suited to slide along said axial direction and outside the first current-carrying terminal.

Preferably, the first current-carrying terminal is provided with a through hole and the second current-carrying terminal is provided with a through hole, said through holes being suited to allow the passage of said at least one operating fluid when the current-carrying terminals are mutually connected to each other.

According to a second aspect of the present invention, the subject of the same is a plasma device comprising a plasma torch, a generator and a connection system suited to connect said torch to said generator, the connection system being carried out as described above.

According to a third aspect of the present invention, the subject of the same is a connector suited to be connected either to a plasma torch or to a generator in order to allow the passage of electric current, the passage of at least one operating fluid and the transmission of one or more control signals between said generator and said torch, said connector comprising a first current-carrying terminal suited to carry said electric current and one or more electric terminals for said one or more control signals, wherein in said connector said electric terminals are movable with respect to said first current-carrying terminal.

Preferably, the electric terminals are movable with respect to the first current-carrying terminal, in such a way that during the connection or disconnection of the connector to/from a second connector respectively associated either to the generator or to the torch, the electric terminals of the connector can assume a first position in which they are disconnected from the respective electric terminals of the second connector and a second position in which they are connected to the electric terminals of the second connector.

According to a preferred embodiment of the invention, the connector comprises a first supporting element for the first current-carrying terminal and a second supporting element for the electric terminals, said second supporting element being movable along an axial direction with respect to the first supporting element, in order to allow the electric terminals to be arranged in the first position or in the second position.

In a preferred embodiment, the connector comprises means suited to define end-of-stroke positions of the second supporting element with respect to the first supporting element in said axial direction.

According to a preferred embodiment of the invention, the connector comprises elastic thrusting means suited to thrust and/or maintain the second supporting element and the electric terminals in the second position.

In a preferred embodiment, the first supporting element comprises a casing suited to integrally support the first current-carrying terminal and the second supporting element comprises a metal ring suited to integrally support the electric terminals.

Preferably, the first current-carrying terminal comprises a body that develops longitudinally along said axial direction and the metal ring is provided with a centre hole suited to accommodate the first current-carrying terminal, said metal ring being suited to slide along the axial direction and outside the first current-carrying terminal.

Preferably, the first current-carrying terminal is provided with a through hole suited to allow the passage of said at least one operating fluid when the connector is connected to a second connector.

According to a fourth aspect of the present invention, the subject of the same is an assembly comprising a plasma torch, a connector for connection to a generator and a torch cable that connects the torch to the connector, wherein the connector is made as described above.

According to a fifth aspect of the present invention, the subject of the same is a method for connecting a first connector to a second connector in a connection system suited to connect a plasma torch to a generator in such a way as to allow the passage of electric current, the passage of at least one operating fluid and the transmission of one or more control signals between said generator and said torch, said connection system comprising said first connector suited to be connected either to said torch or to said generator and said second connector suited to be respectively connected either to said generator or to said torch, said first connector and said second connector being suited to be removably connected to each other, wherein said first connector comprises a first current-carrying terminal suited to carry said electric current and said second connector comprises a second current-carrying terminal suited to carry said electric current, said current-carrying terminals being suited to be mutually connected to each other, and wherein said first connector comprises one or more electric terminals for said one or more control signals and said second connector comprises one or more electric terminals for said one or more control signals, said electric terminals of said connectors being suited to be mutually connected to each other, and wherein said connection method includes a first step of connecting said first current-carrying terminal of said first connector to said second current-carrying terminal of said second connector and a successive second step of connecting said electric terminals of said first connector to said electric terminals of said second connector.

According to a preferred embodiment of the invention, the first step of connecting the first current-carrying terminal of the first connector to the second current-carrying terminal of the second connector takes place through an axial displacement of the first connector towards the second connector.

According to a preferred embodiment of the invention, the second step of connecting the electric terminals of the first connector to the electric terminals of the second connector takes place through an axial displacement of the electric terminals of the first connector towards the electric terminals of the second connector.

Preferably, the connection method includes a step in which the first connector is rotated with respect to the second connector.

Preferably, the method includes an intermediate step between the first connection step and the second connection step, in which the first connector is rotated with respect to the second connector.

According to a sixth aspect of the present invention, the subject of the same is a method for disconnecting a first connector from a second connector in a connection system suited to connect a plasma torch to a generator in such a way as to allow the passage of electric current, the passage of at least one operating fluid and the transmission of one or more control signals between said generator and said torch, said connection system comprising said first connector suited to be connected either to said torch or to said generator and said second connector suited to be respectively connected either to said generator or to said torch, said first connector and said second connector being suited to be removably connected to each other, wherein said first connector comprises a first current-carrying terminal suited to carry said electric current and said second connector comprises a second current-carrying terminal suited to carry said electric current, said current-carrying terminals being suited to be mutually connected to each other, and wherein said first connector comprises one or more electric terminals for said one or more control signals and said second connector comprises one or more electric terminals for said one or more control signals, said electric terminals of said connectors being suited to be mutually connected to each other, and wherein said disconnection method includes a first step in which said electric terminals of said first connector are disconnected from said electric terminals of said second connector and a successive second step in which said first current-carrying terminal of said first connector is disconnected from said second current-carrying terminal of said second connector. According to a preferred embodiment of the invention, the first step in which the electric terminals of the first connector are disconnected from the electric terminals of the second connector takes place through an axial displacement of the electric terminals of the first connector in a direction away from the electric terminals of the second connector.

According to a preferred embodiment of the invention, the second step in which the first current-carrying terminal of the first connector is disconnected from the second current-carrying terminal of the second connector takes place through an axial displacement of the first connector in a direction away from the second connector.

Preferably, the disconnection method includes a step in which the first connector is rotated with respect to the second connector.

Preferably, the method includes an intermediate step between the first disconnection step and the second disconnection step, in which the first connector is rotated with respect to the second connector.

BRIEF DESCRIPTION OF THE DRAWINGS

Further advantages, objectives and characteristics of the present invention are defined in the claims and will be clarified in the following description, making reference to the attached drawings. In particular, in the figures:

FIG. 3C shows a detail of FIG. 3B, isolated from the rest and from another point of view;

FIG. 4C shows an exploded axonometric view of the connector of FIG. 4A;

DETAILED DESCRIPTION OF THE PRESENT INVENTION

Figure 1:
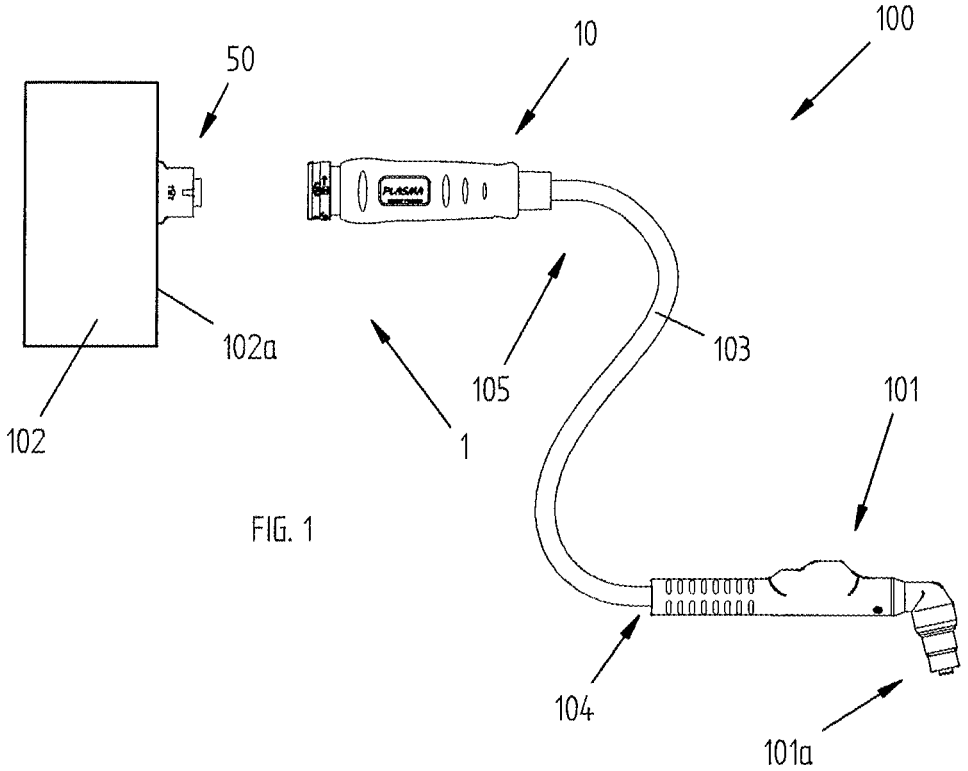
FIG. 1 shows a schematic view of a plasma device carried out according to a preferred embodiment of the present invention.

Even though the present invention is described here below with reference to its embodiment illustrated in the drawings, the present invention is not limited to the embodiment described below and illustrated in the drawings. On the contrary, the embodiment described here below and represented in the drawings clarifies some aspects of the present invention, the scope of which is defined in the claims.

The present invention has proved to be particularly advantageous with reference to plasma cutting systems. It should however be noted that the present invention is not limited to the cutting systems of that type. On the contrary, the present invention can be conveniently applied in all the cases where the use of plasma torches is required, for example for marking purposes.

FIG. 1 schematically shows a cutting device 100 employing plasma technology.

The device 100 preferably comprises an element 101 suited to be handled by the operator, known under the name of torch, at the end of which there is a special electrode 101*a* for the generation of the electric arc.

The device 100 comprises also a unit 102, or generator 102, which is suited to supply electric power to the torch for the generation of the arc and to supply the torch with the fluids necessary for its operation, for example cutting gases (for example, O2 or air), or air and/or cooling water. Furthermore, inside the generator 102 there is the unit for controlling and managing the operation of the plasma device 100.

Between the generator 102 and the torch 101 there is a power supply line 103, or torch cable 103. The torch cable 103 has one end 104 connected to the torch 101 and the other end 105 suited to be connected to the generator 102, as is extensively described here below.

The torch cable 103 first of all provides the electrical connection between the generator 102 and the torch 101 itself, so as to power the electrode 101*a* with the electric current that is necessary for the arc.

Furthermore, said fluids necessary for the operation of the device, for example cutting and/or protection gas and/or air and/or cooling water, as well as the control signals between the generator 102 and the torch 101, are conveyed to the same torch cable 103. Therefore, inside the torch cable 103 there are a plurality of hydraulic and electric conductors suited to enable said electric and/or hydraulic connection and/or the transmission of the control signals.

In the embodiment of the present invention, the electric connection between the generator 102 and the torch 101 is preferably carried out through a tubular connector arranged in the torch cable 103 and made of an electrically conductive material, preferably brass or copper, through which also the cutting and/or protection gas flows. Actually, this is a small tube that serves both as an electric wire and as a duct for conveying the cutting and/or protection gas.

According to the present invention, the end 105 of the torch cable 103 is suited to be removably connected to the generator 102 through a connection system which is indicated as a whole by 1 in the figures.

The connection system 1 comprises a first connector 10 associated with the end 105 of the torch cable 103 and a second connector 50 associated with the generator 102.

The first and the second connector 10 and 50 are shaped in such a way as to allow a rapid connection/disconnection of the torch cable 103 to/from the generator 102.

Figure 2:
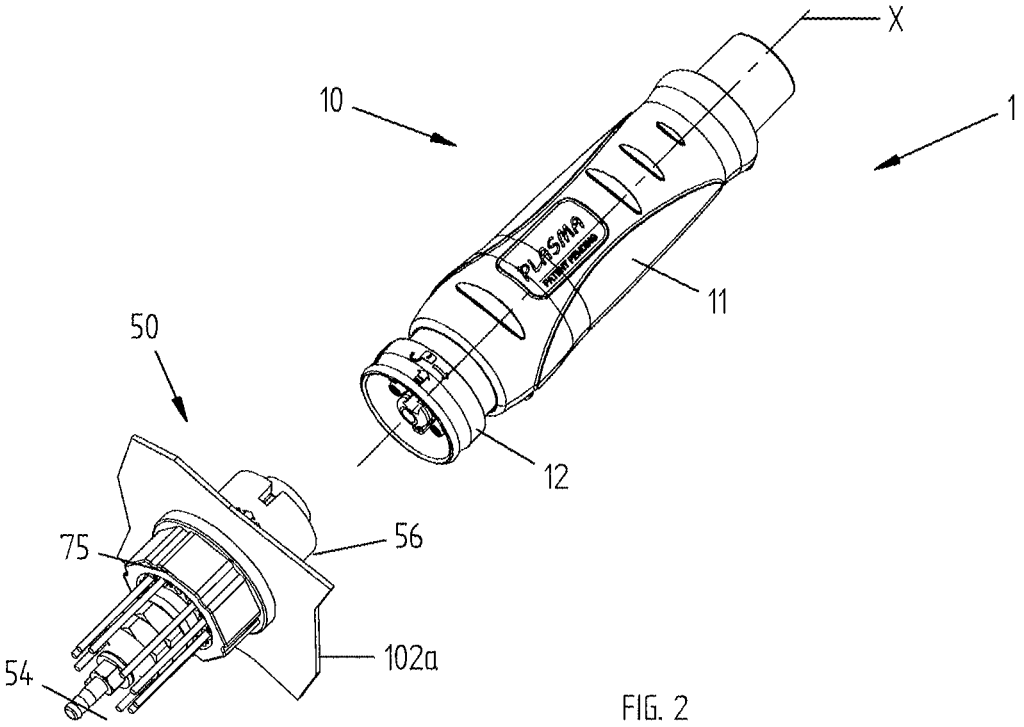
FIG. 2 shows an axonometric view of the connection system carried out according to a preferred embodiment of the present invention and used in the plasma device illustrated in FIG. 1.

The first connector 10 is suited to be connected to the torch cable 103, as explained above, while the second connector 50 is preferably connected to a side wall 102*a* of the generator 102, as can be seen in FIG. 1 and partially also in FIG. 2, which shows also part of the side wall 102*a*.

The first connector 10, as shown in Figures from 4A to 4C, first of all comprises an external casing 11, or first supporting element, preferably shaped in such a way that it can be comfortably held by an operator. The external casing 11 extends longitudinally along a main axis X and is preferably constituted by two half-shells 11*a*, 11*b* connected to each other through connection means 11*c*, the latter preferably comprising fixing screws. The external casing 11 is preferably made of an insulating material, for example rigid plastic.

The following elements are preferably arranged inside the casing 11:

- a metal ring 12, or second supporting element;
- a plurality of electric terminals 13;
- elastic thrusting means 14, preferably constituted by a helical spring 14 and suited to thrust the metal ring 12, as is explained in greater detail below;
- a first current-carrying terminal 15;
- a connection element 40 suited to allow the casing 11 to be coupled with the end 105 of the torch cable 103;
- a sleeve 16 suited to protect the torch cable 103.

The metal ring 12 is substantially provided with a shaped main body 18 and has a first portion 20 suited to be inserted in the casing 11. The first portion 20, which is preferably cylindrical in shape, is delimited by an annular edge 21 on one side and by an undercut edge 22 on the other side. The metal ring 12 is installed inside the casing 11, in such a way that said first portion 20 can house an edge 23 which projects from the inside of the casing 11. In this way, a mutual movement of the metal ring 12 with respect to the casing 11 is allowed, said movement being defined between extreme positions that are respectively defined by the contact of the projecting edge 23 of the casing with the annular edge 21, on the one side, and with the undercut edge 22, on the other side.

In the rest position, meaning, for example, with the first connector 10 disconnected from the second connector 50, the metal ring 12 is held in the rest position corresponding to the first extreme position, that is, with the projecting edge 23 of the casing 11 in contact with the annular edge 21 of the metal ring 12, thanks to the thrusting action exerted by the helical spring 14. The helical spring 14 is installed on the first current-carrying terminal 15, and in particular it rests on a supporting edge 25 of the latter, created on the external surface of the first current-carrying terminal 15. The first current-carrying terminal 15, in turn, is installed in such a way that it is integral with the casing 11.

In order to allow the first current-carrying terminal 15 to be connected to the casing 11 in such a way as to be integral with it, on the first current-carrying terminal 15 there are two plane surfaces 42*a*, 42*b*, of which only the plane surface 42*a* is clearly visible in FIG. 4C and which are coupled with corresponding plane faces 43*b* respectively obtained on the upper half-shell 11*a* and on the lower half-shell 11*b* (only the plane face 43*b* being clearly visible in FIG. 4C).

When the half-shells 11*a*, 11*b* are coupled to each other through the connection means 11*c* (screws), the plane faces 43*b* clamp the plane surfaces 42*a*, 42*b* of the first current-carrying terminal 15 and the first current-carrying terminal 15 remains integral with the casing 11.

The electric terminals 13 are mounted on the metal ring 12 and are integral with it. The electric terminals 13 are accommodated in corresponding seats 26 created in the metal ring 12. On the one side, the electric terminals 13 project towards the outside, meaning towards the second connector 50, and are preferably protected individually by cylindrical portions 65 of the metal ring 12 and preferably enclosed as a whole by a second portion 30 of the metal ring 12, as can be better observed in FIG. 4A. On the other side, the electric terminals 13 are preferably shaped as metal straps in such a way as to allow them to be welded and/or crimped to signal conductors (not shown) that slide inside the torch cable 103.

Figures 4A, 4B, 4E:
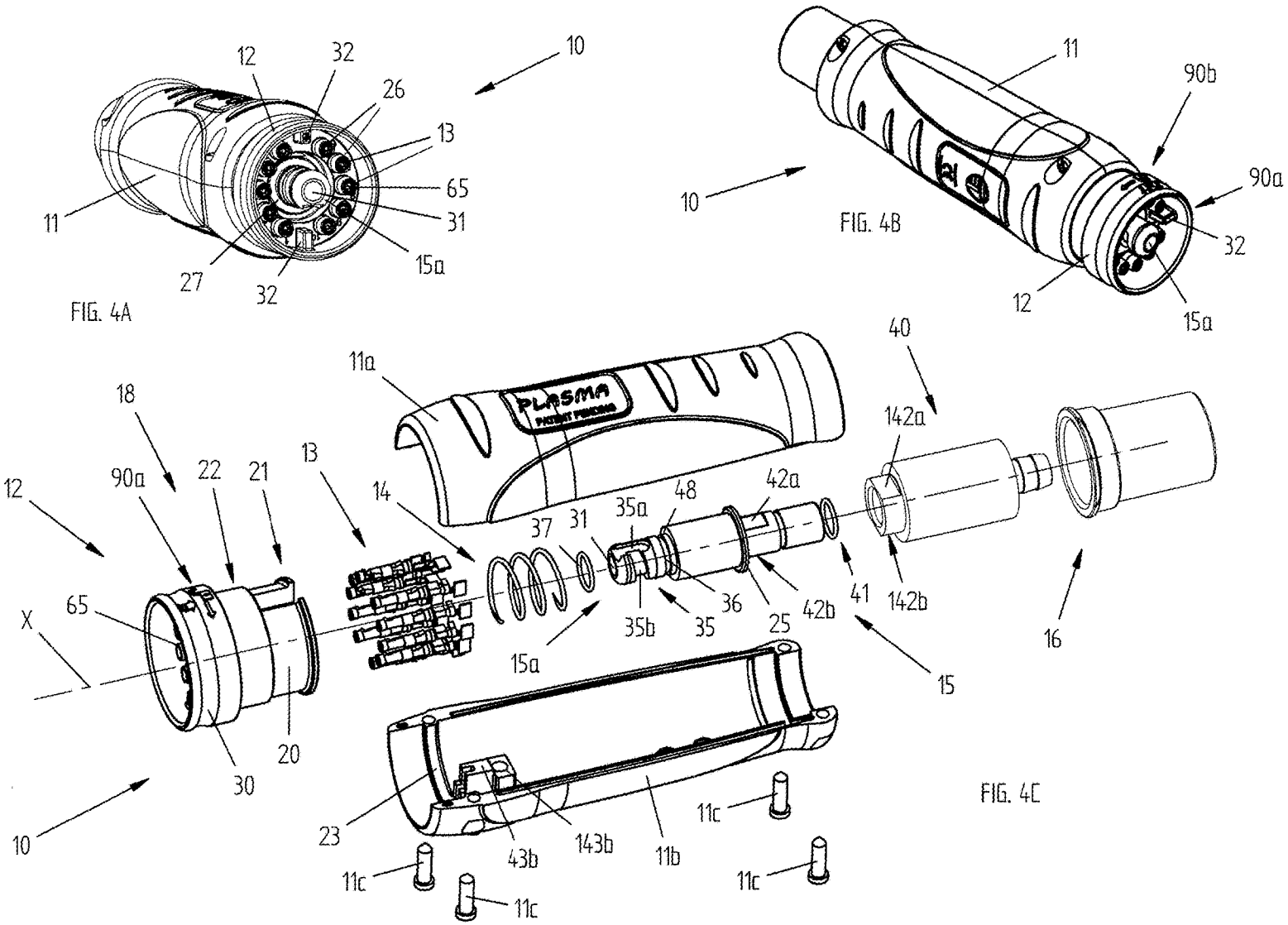
FIG. 4A shows an axonometric view of one of the connectors of the connection system illustrated in FIG. 2, from another point of view.
FIG. 4B shows the connector of FIG. 4A, from another point of view.

The metal ring 12 is also provided with a centre opening 27 from which the end 15*a* of the first current-carrying terminal 15 projects, as can be better seen in FIG. 4A. The end 15*a* of the first current-carrying terminal 15 is also preferably enclosed by the second portion 30 of the metal ring 12.

On the second portion 30 of the metal ring 12, towards the inside, there are two stop elements 32, or teeth 32, whose function is described in greater detail below.

There are also 2 reference symbols 90*a*, 90*b* that are offset by 76° with respect to each other: a first reference symbol 90*a* aligned with the teeth 32 and representing an open lock, visible in FIG. 4C, and a second reference symbol 90*b* offset by approximately 76° with respect to the teeth 32 and representing a closed lock, visible in FIG. 4B.

The first current-carrying terminal 15 has an elongated body, tubular in shape, the inside of which defines a through hole 31 suited to allow the flow of the cutting and/or protection gas. The first current-carrying terminal 15 is made of an electrically conductive material, preferably brass and/or copper.

Furthermore, said supporting edge 25 for the helical spring 14 is defined on the external surface of the first current-carrying terminal 15.

Furthermore, a first contact surface 48, preferably an annular surface perpendicular to the main axis X, is also defined on the external surface of the first current-carrying terminal 15.

The end 15*a* of the first current-carrying terminal 15 is also provided with a shaped groove 35. Said shaped groove 35 comprises a first substantially rectilinear section 35*a* that develops along a first direction, preferably along the direction defined by said main axis X, and a second section 35*b* that develops according to an inclined direction with respect to said first section 35*a*.

Preferably, the second section 35*b* develops on the external surface over a predetermined angle, preferably a 216° angle. More preferably, the second section 35*b* comprises a helical section.

On the external surface of the end 15*a* of the first current-carrying terminal 15 there is also a groove 36 suited to accommodate a hydraulic sealing element 37, preferably an O ring.

The first current-carrying terminal 15 is associated with a connection element 40 in the direction of the torch cable 103, said connection element 40 being tubular in shape and being made of an electrically conductive material, too. The connection element 40 is preferably screwed to the first current-carrying terminal 15. A hydraulic sealing element 41, preferably an O ring, is preferably interposed between the connection element 40 and the first current-carrying terminal 15. The connection element 40 facilitates the connection between the first current-carrying terminal 15 and the above mentioned small tube that serves both as an electric wire and as a duct for conveying the cutting and/or protection gas that is present inside the torch cable 103. In variant embodiments of the invention, said connection element may also be omitted and the first current-carrying terminal 15 may be directly connected to the small tube inside the torch cable or, again, the first current-carrying terminal 15 and the connection element 40 may constitute a single unit.

In order to allow the connection element 40 to be connected to the casing 11 in such a way as to be integral with it, analogously to the situation described above with reference to the first current-carrying terminal 15, the connection element 40 is provided with two plane surfaces 142*a*, 142*b*, of which only the plane surface 142*a* is clearly visible in FIG. 4C and which are coupled with corresponding plane faces 143*b* respectively obtained on the upper half-shell 11*a* and on the lower half-shell 11*b* (only the plane face 143*b* being visible in FIG. 4C).

When the half-shells 11*a*, 11*b* are coupled with each other through the connection means 11*c* (screws), the plane faces 143*b* clamp the plane surfaces 142*a*, 142*b* of the connection element 40 and the connection element 40 remains integral with the casing 11, too.

It is evident that in the case where the first current-carrying terminal 15 and the connection element 40 constitute a single unit, it will be sufficient to make said single unit integral with the casing 11, by proceeding in the same manner as just described above.

Finally, the sleeve 16, preferably made of a plastic material, properly protects the end 105 of the torch cable 103.

The second connector 50, as described above, is suited to be connected to a side wall 102*a* of the generator 102.

As shown in Figures from 3A to 3C, the second connector 50 comprises:

- a shaped main body 51;
- a plurality of electric terminals 47;
- a second current-carrying terminal 53;
- a connection element 54;
- connection means 55 suited to connect the second connector 50 to the side wall 102*a* of the generator 102.

The shaped main body 51 comprises a first portion 56 suited to be housed inside the second portion 30 of the metal ring 12 of the first connector 10.

The first portion 56 is preferably cylindrical in shape. The first portion 56 is delimited on one side by an annular edge 59 suited to be arranged so that it rests against the side wall 102*a* of the generator 102, as shown for example in FIG. 5A.

The first portion 56 has a front surface 56*a* suited to face towards the first connector 10 during the connection step, as described in greater detail below.

The electric terminals 47 are mounted on the shaped main body 51. The electric terminals 47 are housed in corresponding seats 57 created in the main body 51 itself. On one side the electric terminals 47 are arranged towards the outside, that is, towards the first connector 10, and are shaped in such a way that they can be coupled with the electric terminals 13 of the first connector 10. In the embodiment illustrated herein, the electric terminals 47 of the second connector 50 are preferably made in the shape of a pin (male) that is inserted in the electric terminals 13 of the first connector 10 which are made in a tubular shape (female). It is evident that in variant embodiments the electric terminals can be made in a different way in order to allow them to be conveniently coupled with each other.

Vice versa, in the embodiment illustrated herein the terminal portion of the seats 26 that house the electric terminals 13 of the first connector 10 is in the shape of a cylindrical pin (male), while the terminal portion of the seats 57 that house the electric terminals 47 of the second connector 50 are in a tubular cylindrical shape (female). Said terminal portions of the seats contribute to obtaining the mechanical connection between the two connectors 10, 50. It is evident that in variant embodiments said seats can be made in a different way in order to allow them to be conveniently coupled with each other.

Figures 3A, 3B, 3E:
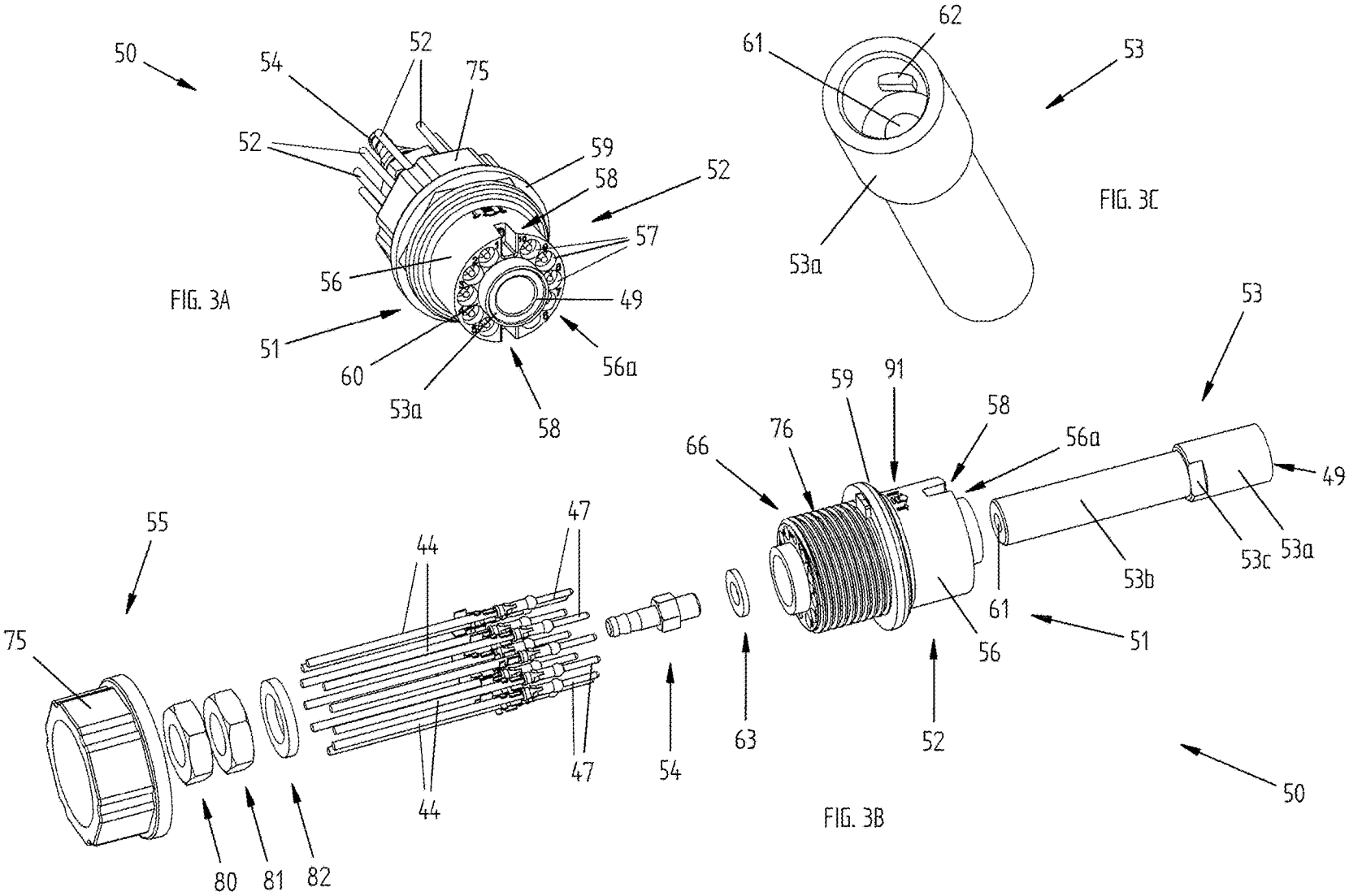
FIG. 3A shows an axonometric view of one of the connectors of the connection system illustrated in FIG. 2, from another point of view.
FIG. 3B shows an exploded axonometric view of the connector of FIG. 3A.

On the other side, meaning towards the inside of the generator 12, the electric terminals 47 of the second connector 50 are preferably shaped in such a way as to allow them to be welded and/or crimped to signal conductors 44, partially visible in FIG. 3B, which are connected to the control and management unit located inside the generator.

The shaped main body 51 is also provided with a centre opening 60 on which the end 53*a* of the second current-carrying terminal 53 is arranged, as can be better observed in FIG. 3A. The end 53*a* of the second current-carrying terminal 53 is suited to accommodate the end 15*a* of the first current-carrying terminal 15 of the first connector 10.

The end 53*a* of the second current-carrying terminal 53 is preferably in a cylindrical tubular shape suited to be coupled with the cylindrical shape of the end 15*a* of the first current-carrying terminal 15.

A second contact surface 49 suited to be placed in contact with the first contact surface 48 of the first current-carrying terminal 15 is defined at the front of the end 53*a* of the second current-carrying terminal 53, as is described in greater detail below.

In the mutual coupling condition, as is better described here below, the hydraulic sealing element 37 (O ring) guarantees the mutual tightness between the two current-carrying terminals 15, 53 of the two connectors 10, 50 of the connection system 1.

On the outside of the first portion 52 of the main body 51 there are two grooves 58, the function of which is described in greater detail below with reference to the teeth 32 of the first metal ring 12.

It is advisable to note the mutual position of the grooves 58 and of the reference symbol 91 made on the external surface of the first portion 52, which are substantially aligned, as can be seen in FIG. 3B.

The second current-carrying terminal 53 comprises an elongated body, tubular in shape, the inside of which defines a through hole 61 suited to allow the passage of the cutting and/or protection gas. The second current-carrying terminal 53 is made of an electrically conductive material, preferably brass and/or copper.

Figures 5A, 5B, 5C, 5D, 5E:
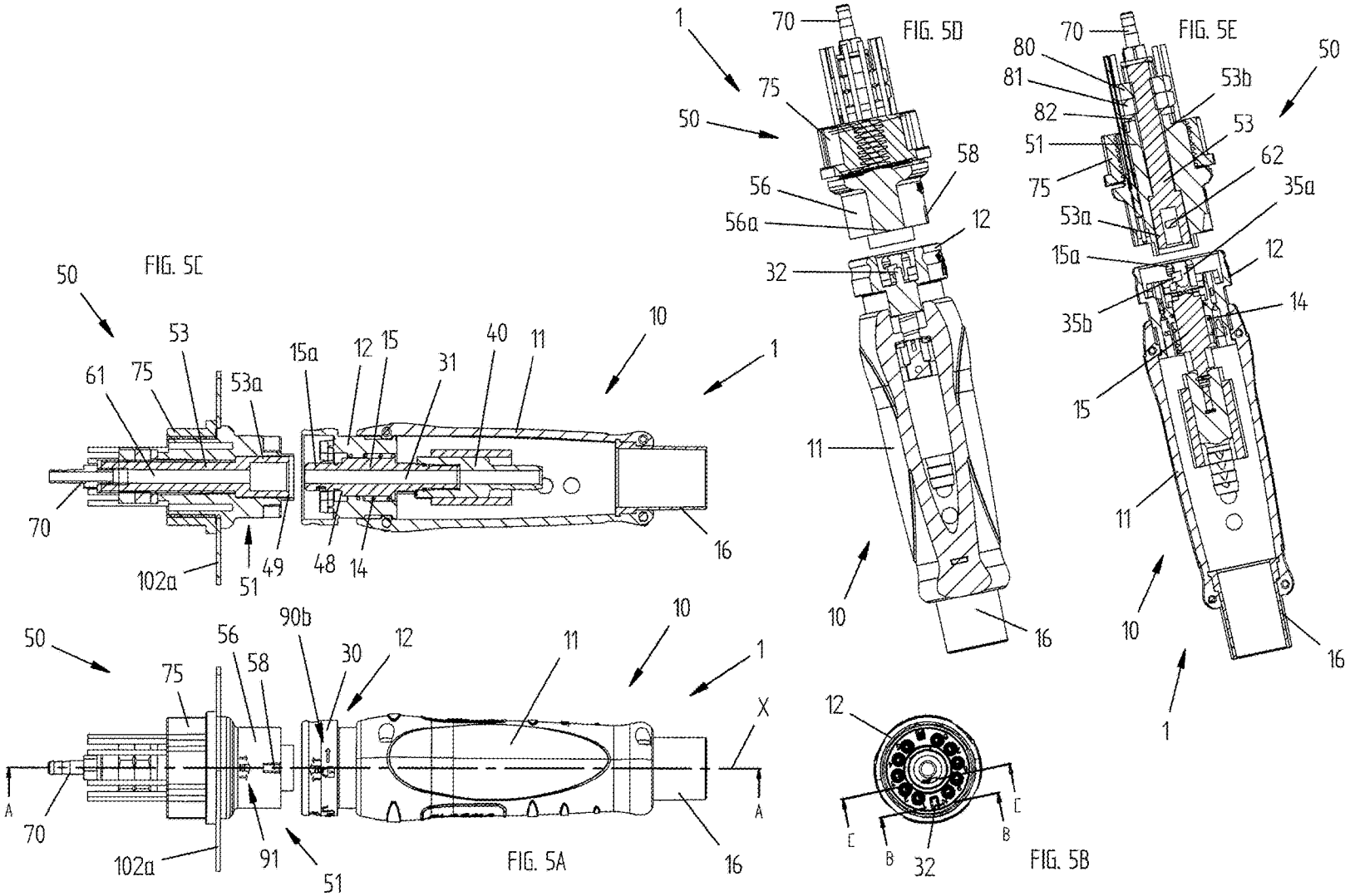
FIG. 5A shows a plan view of the connection system of FIG. 2, in a first position of assembly.
FIG. 5B shows a side plan view of one of the connectors of the system illustrated in FIG. 5A.
FIG. 5C shows the section view along the section line A-A of FIG. 5A.
FIG. 5D shows the section view along the section line B-B of FIG. 5B.
FIG. 5E shows the section view along the section line C-C of FIG. 5B.

The external surface 53*b* of the second current-carrying terminal 53 is preferably threaded, as can be observed for example in FIG. 5E. Said thread is used to secure the second current-carrying terminal 53 to the main body 51 of the second connector 50. For this purpose, first of all, the second current-carrying terminal 53 is externally provided also with a substantially plane surface 53*c* which is suited to be coupled with a corresponding plane surface, not visible, which is present inside the main body 51. Said coupling serves as an anti-rotation system for the second current-carrying terminal 53. Once the second current-carrying terminal 53 has been inserted inside the main body 51, a nut 81 is screwed on the threaded external surface 53*b* of the second current-carrying terminal 53 in order to secure the current-carrying terminal 53 to the main body 51, as shown in FIG. 5E. A washer 82, preferably made of plastic, is preferably interposed between the nut 81 and the main body 51.

Furthermore, also a second nut 80 is preferably screwed on the threaded external surface 53*b*.

The second nut 80 is used to allow the electric connection to the generator, which is preferably obtained using a cable with an eyelet terminal which is associated with the threaded external surface 53*b* of the second current-carrying terminal 53. The eyelet, not shown in the figures, is arranged so that it rests against the nut 81 and then locked by screwing the second nut 80 that fixes it against the nut 81.

On the end 53*a* of the second current-carrying terminal 53 there is a projecting element 62, or tooth 62, which faces towards the inside, as shown in the detail illustrated in FIG. 3C. Said tooth 62 is suited to interact with the shaped groove 35 of the end 15*a* of the first current-carrying terminal 15 of the first connector 10, as is better described below.

The second current-carrying terminal 53 is associated, in the direction towards the inside of the generator 102, with the connection element 54, which is also tubular in shape and made of an electrically conductive material. A sealing element 63, or washer 63, is preferably interposed between the connection element 54 and the second current-carrying terminal 53. The connection element 54 facilitates the connection between the second current-carrying terminal 53 and the parts of the generator that serve for generating the cutting and/or protection gas. In variant embodiments of the invention, said connection element may also be omitted and the second current-carrying terminal 53 may be connected in another manner to the corresponding supply units or, again, the connection element 54 and the second current-carrying terminal 53 may constitute a single element.

The connection means 55 for connection to the side wall 102*a* of the generator 102 preferably comprise a closing metal ring 75 which is threaded internally and is coupled with an external thread 76 made on a portion 66 of the external surface of the main body 51.

Figures from 5 to 9 show some steps illustrating the method for connecting the first connector 10 to the second connector 50 of the connection system 1, according to the preferred embodiment of the present invention.

FIGS. 5A-5E show the connection system 1 in a first step, with the first connector 10 disconnected from the second connector 50, or rest step.

The first connector 10 is arranged in front of the second connector 50, in such a way that the second reference symbol 90*b* (closed lock) of the metal ring 12 is aligned with the reference symbol 91 provided on the external surface of the first portion 52 of the second connector 50.

In a successive step (FIGS. 6A-6E), the first connector 10 is moved near the second connector 50 by moving the first connector 10 towards the second connector 50 substantially along the direction defined by the main axis X. The step illustrated in FIGS. 6A-6E is related to a first temporary position in which the first portion 56 of the main body 51 of the second connector 50 is partially housed inside the second portion 30 of the metal ring 12 of the first connector 10 and in which the front surface 56*a* of the first portion 56 of the main body 51 is arranged in such a way that it rests against the teeth 32 of the metal ring 12 of the first connector 10 (as can be observed in particular in FIG. 6D).

Figures 6A, 6B, 6C, 6D, 6E:
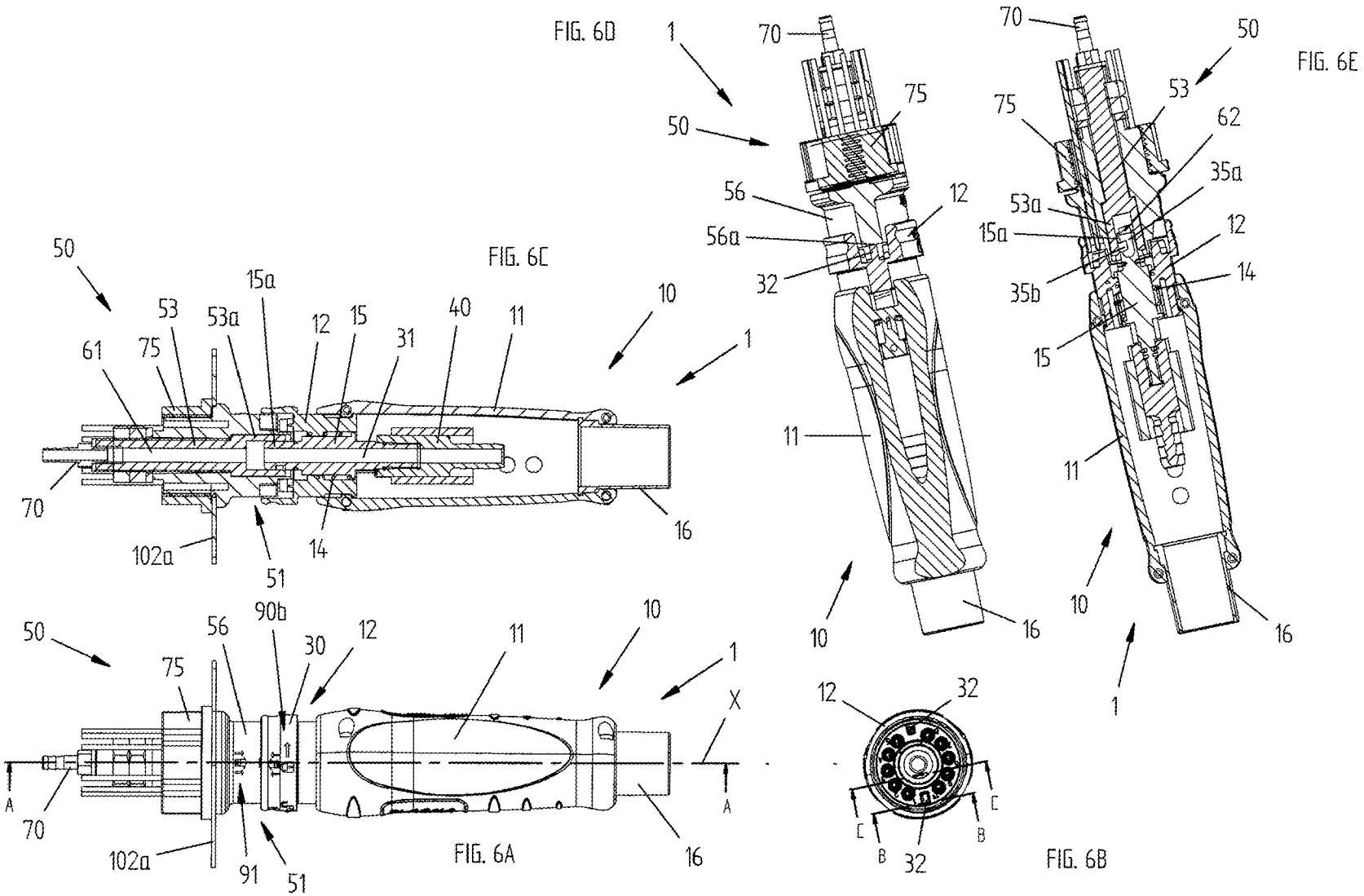
FIG. 6A shows a plan view of the connection system of FIG. 2, in a second position of assembly.
FIG. 6B shows a side plan view of one of the connectors of the system illustrated in FIG. 6A.
FIG. 6C shows the section view along the section line A-A of FIG. 6A.
FIG. 6D shows the section view along the section line B-B of FIG. 6B.
FIG. 6E shows the section view along the section line C-C of FIG. 6B.

At the same time, the end 15*a* of the first current-carrying terminal 15 of the first connector 10 is partially inserted in the end 53*a* of the second current-carrying terminal 53 of the second connector 50 (as can be observed in FIGS. 6C and 6E). The tooth 62 on the end 53*a* of the second current-carrying terminal 53 is housed in the first section 35*a* of the shaped groove 35 on the end 15*a* of the first current-carrying terminal 15, as can be observed in FIG. 6E.

In a successive step (FIGS. 7A-7E), the first connector 10 is moved further towards the second connector 50. The front surface 56*a* of the first portion 56 of the main body 51 is still resting against the teeth 32 of the metal ring 12 of the first connector 10 (as can be observed in particular in FIG. 7D), so that the metal ring 12 is moved with respect to the casing 11 of the first connector 10, thus compressing/loading the helical spring 14, as can be observed also in FIG. 7C.

Figures 7A, 7B, 7C, 7D, 7E:
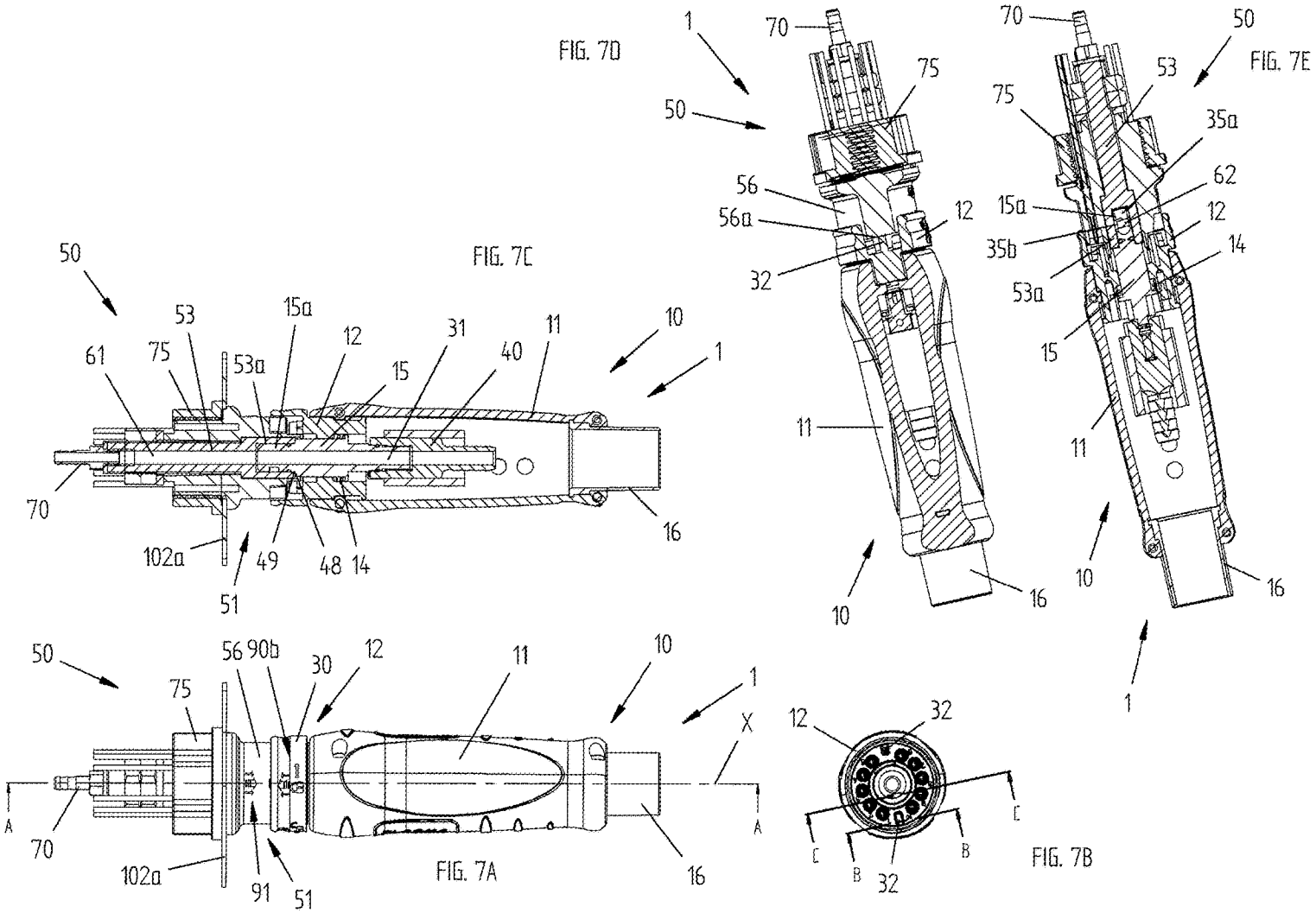
FIG. 7A shows a plan view of the connection system of FIG. 2, in a third position of assembly.
FIG. 7B shows a side plan view of one of the connectors of the system illustrated in FIG. 7A.
FIG. 7C shows the section view along the section line A-A of FIG. 7A.
FIG. 7D shows the section view along the section line B-B of FIG. 7B.
FIG. 7E shows the section view along the section line C-C of FIG. 7B.
Figures 8A, 8B, 8C, 8D, 8E:
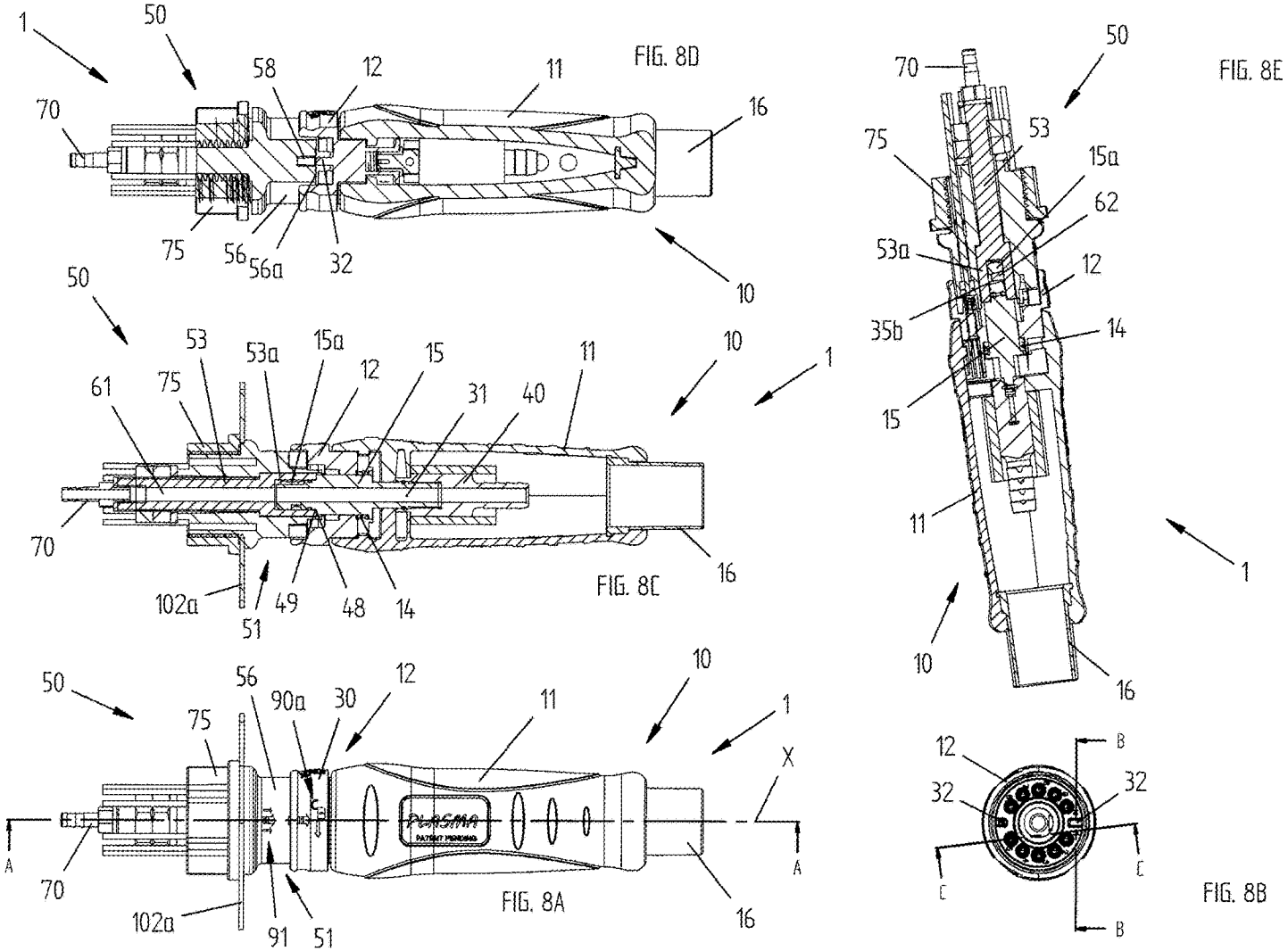
FIG. 8A shows a plan view of the connection system of FIG. 2, in a fourth position of assembly.
FIG. 8B shows a side plan view of one of the connectors of the system illustrated in FIG. 8A.
FIG. 8C shows the section view along the section line A-A of FIG. 8A.
FIG. 8D shows the section view along the section line B-B of FIG. 8B.
FIG. 8E shows the section view along the section line C-C of FIG. 8B.

At the same time, the end 15*a* of the first current-carrying terminal 15 of the first connector 10 is further and completely inserted in the end 53*a* of the second current-carrying terminal 53 of the second connector 50, until the first contact surface 48 of the first current-carrying terminal 15 comes into contact with the second contact surface 49 of the second current-carrying terminal 53, as can be observed in FIG. 7C. Said contact between the contact surfaces 48, 49 serves as an end of stroke for the movement of the casing 11 of the first connector 10 towards the second connector 50. The contact surfaces 48, 49 in mutual contact also serve, in a successive step, as a current passage area between the two connectors 10, 50.

During this step the hydraulic sealing element 37 (O ring 37) can serve its sealing function.

The tooth 62 on the end 53*a* of the second current-carrying terminal 53 is further inserted in the first section 35*a* of the shaped groove 35 on the end 15*a* of the first current-carrying terminal 15, until reaching the mouth of the second section 53*b* of the shaped groove 35 (as can be observed in FIG. 7E), that is, in a position that allows the mutual rotation of the two current-carrying terminals 15, 53.

It should be noted that in said operating position the first current-carrying terminal 15 of the first connector 10 and the second current-carrying terminal 53 of the second connector 50 are already in operating position and can serve both the function of transmitting electric current and the function of conveying the cutting and/or protection gas through the respective through holes 31, 61, even though the mutual axial locking is not yet guaranteed.

However, to advantage, as the electric terminals 13 of the first connector 10 are not yet connected to the electric terminals 47 of the second connector 50, the torch 101 with the torch cable 103 are not yet connected through the control signals coming from the control and management unit of the generator 102. The torch 101, therefore, is not fed either with the electric current or with the cutting and/or protection gas yet. Advantageously, this condition is safe for the operator.

In a successive step (FIGS. 8A-8E), the first connector 10 is rotated with respect to the second connector 50. The first connector 10 is rotated with respect to the second connector 50 until the first reference symbol 90*a* (open lock) of the metal ring 12 is aligned with the reference symbol 91 provided on the external surface of the first portion 52 of the second connector 50.

During the rotation, the front surface 56*a* of the first portion 56 of the main body 51 is still resting against the teeth 32 of the metal ring 12 of the first connector 10, until the teeth 32 of the metal ring 12 are aligned with the grooves 58 on the first portion 56 of the main body 51. This situation is illustrated in FIGS. 8A-8E, and can be observed in particular in FIG. 8D.

The extent of the rotation of the first connector 10 required to reach said situation of alignment of the teeth 32 with the grooves 58 depends on the mutual offset between the position of the teeth 32 and the reference symbols 90*a*, 90*b* of the first connector 10 and on the mutual offset between the grooves 58 and the reference symbol 91 of the second connector 50. In the embodiment shown and described herein, said angle is preferably a 76° angle. It is evident that in variant embodiments said angle may have different values.

During said rotation, furthermore, the tooth 62 on the end 53*a* of the second current-carrying terminal 53 slides inside the second section 35*b* of the shaped groove 35 which, being slightly inclined, serves the function of securing the first current-carrying terminal 15 to the second current-carrying terminal 53, in particular at the level of the contact surfaces 48, 49 that were previously placed in contact with each other. The securing operation is performed thanks to the micro deformations to which the tooth 62 is subjected when it comes into contact with the inside of the second section 35*b* of the shaped groove 35.

Always in the situation illustrated in FIGS. 8A-8E, even the electric terminals 13 of the first connector 10 are aligned with the respective electric terminals 47 of the second connector 50, even though they are not connected yet.

From the configuration just described above with reference to FIGS. 8A-8E, thanks to the fact that the teeth 32 are aligned with the grooves 58, the metal ring 12 of the first connector 10 can move axially towards the second connector 50 as a result of the thrusting action of the previously loaded helical spring 14.

Therefore, in this situation the metal ring 12 is automatically thrust towards the second connector 50, obviously provided that the metal ring 12 itself is not held still by the operator's hand.

Figure 9E:
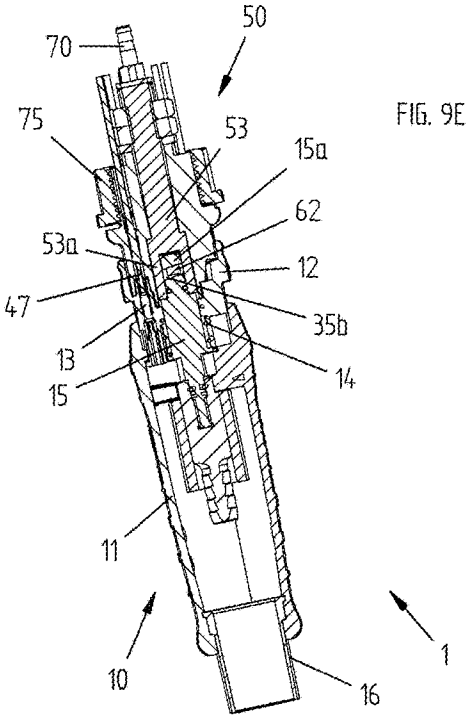
FIG. 9E shows the section view along the section line C-C of FIG. 9B.
Figure 9B:
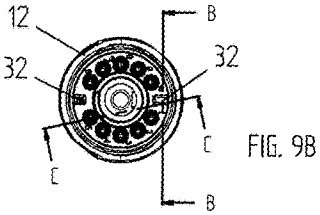
FIG. 9B shows a side plan view of one of the connectors of the system illustrated in FIG. 9A.
Figure 9D:
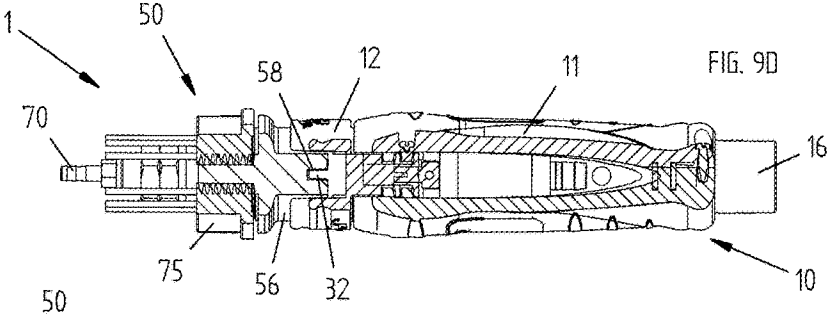
FIG. 9D shows the section view along the section line B-B of FIG. 9B.
Figure 9C:
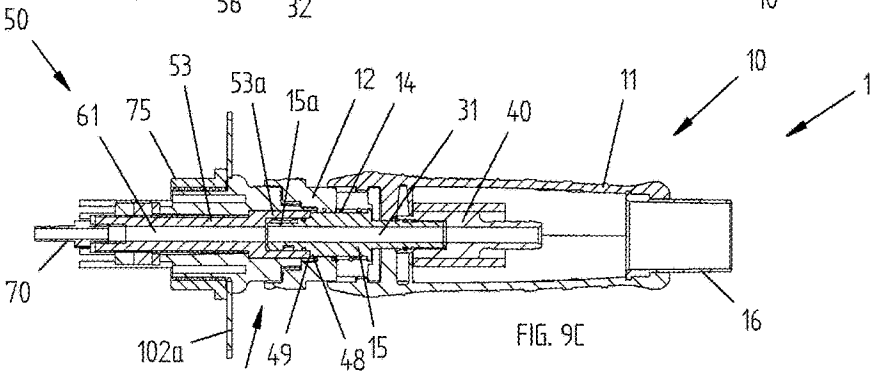
FIG. 9C shows the section view along the section line A-A of FIG. 9A.
Figure 9A:
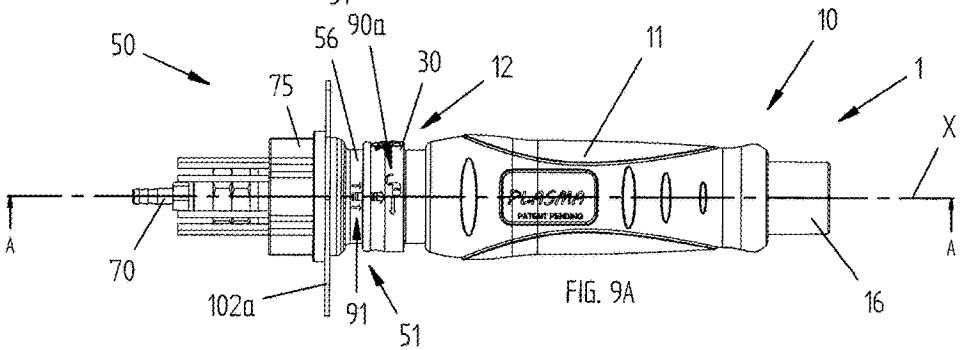
FIG. 9A shows a plan view of the connection system of FIG. 2, in a fifth position of assembly.

The successive step, with the metal ring 12 completely thrust towards the second connector 50, is illustrated in FIGS. 9A-9E. The teeth 32 of the metal ring 12 of the first connector 10 are inserted completely in the grooves 58 located on the first portion 56 of the main body 51 of the second connector 50, as shown in FIG. 9D.

The electric terminals 13 of the first connector 10 provide the electric contact with the corresponding electric terminals 47 of the second connector 50. The connection of one of the electric terminals 13 of the first connector 10 with a corresponding electric terminal 47 of the second connector 50 is visible in FIG. 9E.

This situation is advantageously maintained as described due to the thrusting action exerted by the helical spring 14.

In this operating condition, the torch 101 can be used by the operator, since all the necessary connections are carried out by the connection system 1, that is, the electric power supply required for the generation of the arc, the supply of cutting and/or protection gas and the transmission of the control signals coming from the control and management unit (for example, the signal emitted by the start/stop button, safety signals such as the safety signal related to the spare parts installed, any other specific signals related to the generator used).

The current for the torch 101, in particular, flows through the contact surfaces 48, 49 and in contact with the first and the second current-carrying terminal 15, 53.

The description provided above advantageously shows how the connection system that is the subject of the invention makes it possible to carry out a simplified, automatic and safe connection of the two connectors.

Advantageously, furthermore, the device 100 operates in safe conditions during the connection of the two connectors, as the operation of the electric current and the supply of cutting and/or protection gas are activated only once the control signals have been activated.

As regards the steps of disconnection of the first connector 10 from the second connector 50, it will be sufficient to carry out said connection operations chronologically, in the reverse order compared to the operations just described above.

In particular, from the position shown in Figures from 9A to 9D (operating condition), the operator moves the metal ring 12, pulling it away from the second connector 50 and against the thrusting force of the helical spring 14 (thus reaching the operating condition illustrated in FIGS. 8A-8E). During said first step the electric terminals 13 of the first connector 10 are disconnected from the respective electric terminals 47 of the second connector 50. Advantageously, the device 100 is immediately set in a safe condition, as all the control signals are deactivated and consequently any possible operation resulting from the electric current and from the supply of cutting and/or protection gas is deactivated, too.

In the successive step, the first connector 10 with the metal ring 12 in the previously obtained retracted position is rotated, preferably by 76° in the embodiment illustrated herein, and brought back to the position illustrated in FIGS. 7A-7E. At this point, the first connector 10 can be disconnected by moving it away from the second connector 50 along the main direction X (FIGS. 6A-6E and 5A-5E).

Even though in the embodiment illustrated herein the first connector is associated with the torch side, and in particular with the torch cable, and the second connector is associated with the generator side, it should be noted that in variant embodiments of the invention the position of the two connectors may be exchanged through simple adaptations that can be easily carried out by an expert in the art, so that the first connector may be associated with the generator and the second connector may be associated with the torch side.

Furthermore, even though in the embodiment illustrated herein the elastic thrusting means 14, preferably constituted by a helical spring 14, act on the metal ring 12, it should be noted that in variant embodiments of the invention said thrusting means 14 may be omitted and the positions of the metal ring 12 during the various connection/disconnection steps may be obtained manually by the operator, who can act directly on the metal ring 12.

It has thus been shown, through the description provided above, that the connection system carried out according to the present invention makes it possible to achieve the set objects. In particular, the connection system according to the present invention makes it possible to simplify the connection/disconnection operations and/or to improve the safety conditions compared to the connection systems of the known type.

Even though the present invention has been previously illustrated through the detailed description of an embodiment of the same which is represented in the drawings, the present invention is not limited to the embodiment described above and represented in the drawings; on the contrary, further variants of the embodiment described herein fall within the scope of the present invention, which is defined in the claims.

The invention claimed is:

1. A connector (10) suited to be connected either to a plasma torch (101) or to a generator (102) in order to allow the passage of electric current, the passage of at least one operating fluid and of one or more control signals between said generator (102) and said torch (101), said connector (10) comprising:

a first current-carrying terminal (15) suited to carry said electric current and one or more electric terminals (13) for said one or more control signals, said connector (10) further comprising that said electric terminals (13) are movable with respect to said first current-carrying terminal (15), wherein said electric terminals are movable with respect to said first current-carrying terminal, in such a way that during the connection or disconnection of said connector to or from a second connector respectively associated either to said torch or to said generator, the electric terminals of said connector are configured to a first position in which they are disconnected from the respective electric terminals of said second connector and a second position in which they are connected to said electric terminals of said second connector, and wherein said connector comprises a first supporting element for said first current-carrying terminal and a second supporting element for said electric terminals, said second supporting element being movable along an axial direction (X) with respect to said first supporting element, in order to allow said electric terminals to be arranged in said first position or in said second position.

2. The connector (10) according to claim 1, wherein the connector further comprises means suited to define end-of-stroke positions of said second supporting element (12) with respect to said first supporting element (11) in said axial direction (X).

3. The connector (10) according to claim 1, wherein said connector (10) comprises elastic thrusting means (14) suited to thrust or hold said second supporting element (12) and said electric terminals (13) in said second position.

4. The connector (10) according to claim 1, wherein said first supporting element (11) comprises a casing (11), which is integral with and supports said first current-carrying terminal (15), and said second supporting element (12) comprises a metal ring (12), which is integral with and supports said electric terminals (13).

5. The connector (10) according to claim 4, wherein said first current-carrying terminal (15) comprises a body that develops longitudinally along said axial direction (X) and said metal ring (12) is provided with a central hole suited to accommodate said first current-carrying terminal (15), said metal ring (12) being suited to slide along said axial direction (X) and externally to said first current-carrying terminal (15).

6. An assembly comprising a plasma torch (101), a connector (10) according to claim 1 suitable for connection to a generator (102) and a torch cable (101) suited to connect said torch (101) to said connector (10).

7. A connection system (1) suited to connect a plasma torch (101) to a generator (102) in order to allow the passage of electric current, the passage of at least one operating fluid, and of one or more control signals between said generator (102) and said torch (101), said connection system (1) comprising:

a first connector (10) and a second connector (50) suited to be respectively connected either to said generator (102) or to said torch (101), said first connector (10) and said second connector (50) being suited to be removably connected to each other, wherein said second connector (50) comprises a second current-carrying terminal (53) suited to carry said electric current, said current-carrying terminals (15, 53) being suited to be mutually connected to each other, wherein said second connector (50) comprises one or more electric terminals (47) for said one or more control signals, said electric terminals (13, 47) of said connectors being suited to be mutually connected to each other, wherein said electric terminals are movable in such a way that during the connection or disconnection of said first connector to or from said second connector, said first current-carrying terminal and said second current-carrying terminal are electrically connected to each other, while said electric terminals of said first connector are configured to a first position in which they are disconnected from said electric terminals of said second connector and a second position in which they are connected to said electric terminals of said second connector, and wherein said first connector comprises a first supporting element for said first current-carrying terminal and a second supporting element for said electric terminals, said second supporting element being movable along an axial direction (X) with respect to said first supporting element, in order to allow said electric terminals (13) to be arranged in said first position or in said second position.

8. The system (1) according to claim 7, wherein the system comprises means suited to define end-of-stroke positions of said second supporting element (12) with respect to said first supporting element (11) in said axial direction (X).

9. The system (1) according to claim 7, wherein said first connector (10) comprises elastic thrusting means (14) suited to thrust or hold said second supporting element (12) and said electric terminals (13) in said second position.

10. The system (1) according to claim 7, wherein said first supporting element (11) comprises a casing (11), which is integral with and supports said first current-carrying terminal (15), and said second supporting element (12) comprises a metal ring (12), which is integral with and supports said electric terminals (13).

11. The system (1) according to claim 10, wherein said first current-carrying terminal (15) comprises a body that develops longitudinally along said axial direction (X) and said metal ring (12) is provided with a central hole suited to accommodate said first current-carrying terminal (15), said metal ring (12) being suited to slide along said axial direction (X) and externally to said first current-carrying terminal (15).

12. A plasma device (100) comprising a plasma torch (101), a generator (102) and a connection system (1) suited to connect said torch (101) to said generator (102) according to claim 7.

* * * * *